United States Patent [19]

Zodrow et al.

[11] 4,280,866

[45] Jul. 28, 1981

[54] LABELING STATION

[75] Inventors: Rudolf Zodrow, Dusseldorf; Egon Höveler, Haan, both of Fed. Rep. of Germany

[73] Assignee: Jagenberg Werke AG, Dusseldorf, Fed. Rep. of Germany

[21] Appl. No.: 81,990

[22] Filed: Oct. 4, 1979

[30] Foreign Application Priority Data

Oct. 20, 1978 [DE] Fed. Rep. of Germany ..... 2845645

[51] Int. Cl.[3] ..... B65C 9/16; B65C 9/36

[52] U.S. Cl. ..... 156/568; 156/571; 156/DIG. 14; 156/DIG. 32; 156/DIG. 42

[58] Field of Search ..... 156/567, 568, 571, 578, 156/DIG. 25, DIG. 29, DIG. 32, DIG. 42, DIG. 14, 560

[56] References Cited

U.S. PATENT DOCUMENTS

| | | | |
|---|---|---|---|
| 4,032,388 | 6/1977 | Dunning | 156/568 |
| 4,092,207 | 5/1978 | Zodrow | 156/568 |
| 4,118,269 | 10/1978 | Zodrow et al. | 156/571 |
| 4,146,421 | 3/1979 | Zodrow | 156/571 |

*Primary Examiner*—Michael G. Wityshyn
*Attorney, Agent, or Firm*—Sprung, Felfe, Horn, Lynch & Kramer

[57] ABSTRACT

In a labeling station for applying labels onto objects, having at least one pickup element mounted eccentrically on a rotatable carrier for movement about an axis, a gripper cylinder comprising a rotating carrier having eccentrically disposed gripping and pressing elements thereon, which elements are tangent to the circulation path of the pickup elements approximately in synchronism, the labels being transferred by the gripping and pressing elements to objects moved along a transport path, the part of the gripper cylinder which carries the pressing elements being eccentrically mounted on the gripper-cylinder shaft in such a way that the areas to be labeled of the objects are tangent to or slightly intersected by the path of rotation of the pressing elements, and the part carrying the pressing elements and the part carrying the gripping elements rotate with the same angular velocity, the improvement comprising means for adapting the rotative speed of the pressing elements to the path speed of the areas to be labeled of a first group of objects being conveyed along an arcuate path whose areas to be labeled are, in relation to the areas to be labeled of another group of objects being conveyed along an arcuate path, at a different distance from the gripper-cylinder axis including means for releasably replacing the part carrying the pressing elements with another part of a different diameter carrying pressing elements.

3 Claims, 10 Drawing Figures

LABELING STATION

The present invention relates to labeling stations having at least one pickup element eccentrically mounted for swinging or rotating motion on a rotating carrier for labels to be affixed to objects, and having a rotating gripper cylinder which carries on its circumference gripping and pressing elements for the labels which are transferred by said gripping and pressing elements to objects being moved along a conveying path.

The gripping and pressing elements move tangentially to the path of rotation of the pickup elements, approximately in synchronism therewith and execute a swinging or rotating movement while picking up a label. It is customary for the carrier of the pickup elements to be coupled rigidly drivewise, for example, through a gear train, to the gripper cylinder and for the entire labeling station, that is to say, carrier with gripping cylinder, label box and glue roll to be rotatable as a unit about the carrier axis. Through the displacement of the circular path of the gripping and pressing elements in the direction of the conveying path of the objects due to such rotation, the different distances of the areas to be labeled from the labeling station which are due to the different formats of the objects can be spanned. Since in the rotation of the entire labeling station the geometric and drive relations between the carrier with its pickup elements and the gripper cylinder do not change, a tangential range of synchronism sufficient for satisfactory takeup of the labels from the pickup elements by the gripping elements is maintained. However, difficulties arise in the transfer of the labels from the gripper cylinder to the areas to be labeled since these areas have a path speed differing from that of the gripping elements, and particularly of the pressing elements owing to the velocity of the objects traveling along an arcuate path with different radii of curvature of the paths of the areas to be labeled. That means that in the range of transfer of the labels to the objects there is no synchronism between the areas to be labeled and the pressing elements. However, synchronism between pressing elements and areas to be labeled is essential to satisfactory transfer of the labels.

In U.S. Pat. No. 4,118,269 the labeling station is designed for the affixing of labels to be applied one above the other to objects. The areas to be labeled of each object move along paths at different distances from the gripper-cylinder axis. In order to maintain, on the one hand, sufficient synchronism between the gripper cylinder and the pickup elements and to span, on the other hand, the different distances from the areas to be labeled, provision is made in the apparatus therein for the gripper cylinder to consist of two parts of different diameters which are arranged one above the other and are so disposed eccentrically relative to each other that while maintaining a sufficient tangential range of synchronism at the pickup elements the areas to be labeled are tangent to or slightly intersected by the paths of rotation of the gripping and pressing elements, and that the two gripper cylinders are drivewise coupled to each other in such a way that they rotate with the same angular velocity. The idea underlying this teaching is that through the selection of the diameter of one gripping-cylinder part and through its eccentric position with equal angular velocity of both gripper-cylinder parts and adequate tangential range of synchronism at the pickup elements as well as the same path speed in the labeling range can be obtained for both the upper and lower labels. This principle is utilized also in the invention.

SUMMARY OF THE INVENTION

The object of the present invention is to provide a labeling station of the aforementioned type in which allowance can be made for the different path speeds of the areas to be labeled, as a function of the distance of the conveying path of the areas from the labeling station, which result, for example, when different groups of objects travel along the same conveying path, or when groups of objects travel along different conveying paths.

In accordance with the invention, this object is accomplished in that for adaptation of the rotative speed of the pressing elements to the path speed of the areas to be labeled of a first group of objects which are being conveyed along an arcuate path, and whose areas to be labeled are at a distance from the gripper-cylinder axis different from that of another group of objects being conveyed along an arcuate path, the part carrying the pressing elements is exchangeable for another part of a different diameter carrying pressing elements.

The apparatus of the present invention includes a labeling station having at least one pickup element eccentrically mounted on a rotating carrier, and mounted for swinging or rotating motion, for labels to be affixed to objects, and having a rotating gripper cylinder which carries on its circumference gripping and pressing elements for the labels which are transferred by said gripping and pressing elements to objects being moved along a conveying path, said gripping and pressing elements being tangent to the path of rotation of the pickup elements, approximately in synchronism, which execute a swinging or rotating movement while picking up a label, the part of the cylinder which carries the pressing elements being eccentrically mounted on the gripper-cylinder shaft in such a way that the areas to be labeled of the objects are tangent to or slightly intersected by the path of rotation of the pressing elements, and the part carrying the pressing elements being coupled drivewise to the part carrying the gripping elements in such a way that the part carrying the pressing elements and the part carrying the gripping elements rotate with the same angular velocity.

Such a labeling station permits different object formats to be labeled. The different path speeds of the areas to be labeled resulting from the different object formats are allowed for in the diameter of the part carrying the pressing elements in such a way that with constant angular velocity of that part the circumferential speed of the pressing elements coincides with the path speed of the areas to be labeled. The different distance of the areas to be labeled from the labeling station is allowed for on the one hand by turning the entire labeling station and on the other hand by shifting the eccentric of the part carrying the pressing elements so that the path of rotation of the pressing elements is tangent to or slightly intersects the path of the areas to be labeled.

When only the part of the gripper cylinder carrying the pressing elements is eccentrically mounted, then the relationships with respect to the tangential range of synchronism of the gripping elements and the pickup elements are unchanged in any angular position of the labeling station determined by the different object formats. Since in the transfer of the labels to the objects the gripping elements only have the subordinate function of bringing the labels into proximity to the areas to be labeled, synchronism between gripping elements and areas to be labeled is not required. All that matters here is that the pressing elements move with the same path speed as the areas to be labeled. The gripping elements will release the labels as soon as the latter come within reach of the pressing elements. Since the synchronism requirement is more critical in the vicinity of the areas to be labeled than in the vicinity of the pickup elements, all that matters in the vicinity of the pickup elements is that the gripping elements be tangent to the path of the pickup elements over an adequate range. Based on this realization, a refinement of the invention provides for the part carrying the pressing elements and the part carrying the gripping elements to be eccentrically mounted on the gripper-cylinder shaft as exchangeable units. With this refinement of the invention, the gripping elements and the pressing elements can be brought into proximity of the conveying path simply by turning the entire labeling station so that these elements are tangent to or intersect the path of the areas to be labeled. The path speeds of these elements can be adapted to the path speed of the areas to be labeled through selection of the diameter of the unit. By means of the eccentric the unit can be adjusted so that there is an adequate tangential range between the path of the gripping elements and that of the pickup elements. While with a maximum diameter of the unit there can be synchronism also at the pickup elements, it will not be possible to satisfy the synchronism requirement with a smaller diameter of the units. In that case the pickup element will slightly lead the gripping elements. This lead is not objectionable since the label is not subjected to tensile stress in the tangential direction of the pickup element; only the pull-away point is shifted somewhat on the pickup face of the pickup element.

The invention is explained in greater detail below with reference to the drawings illustrating exemplified embodiments wherein:

DETAILED DESCRIPTION OF THE INVENTION

Figure 1:
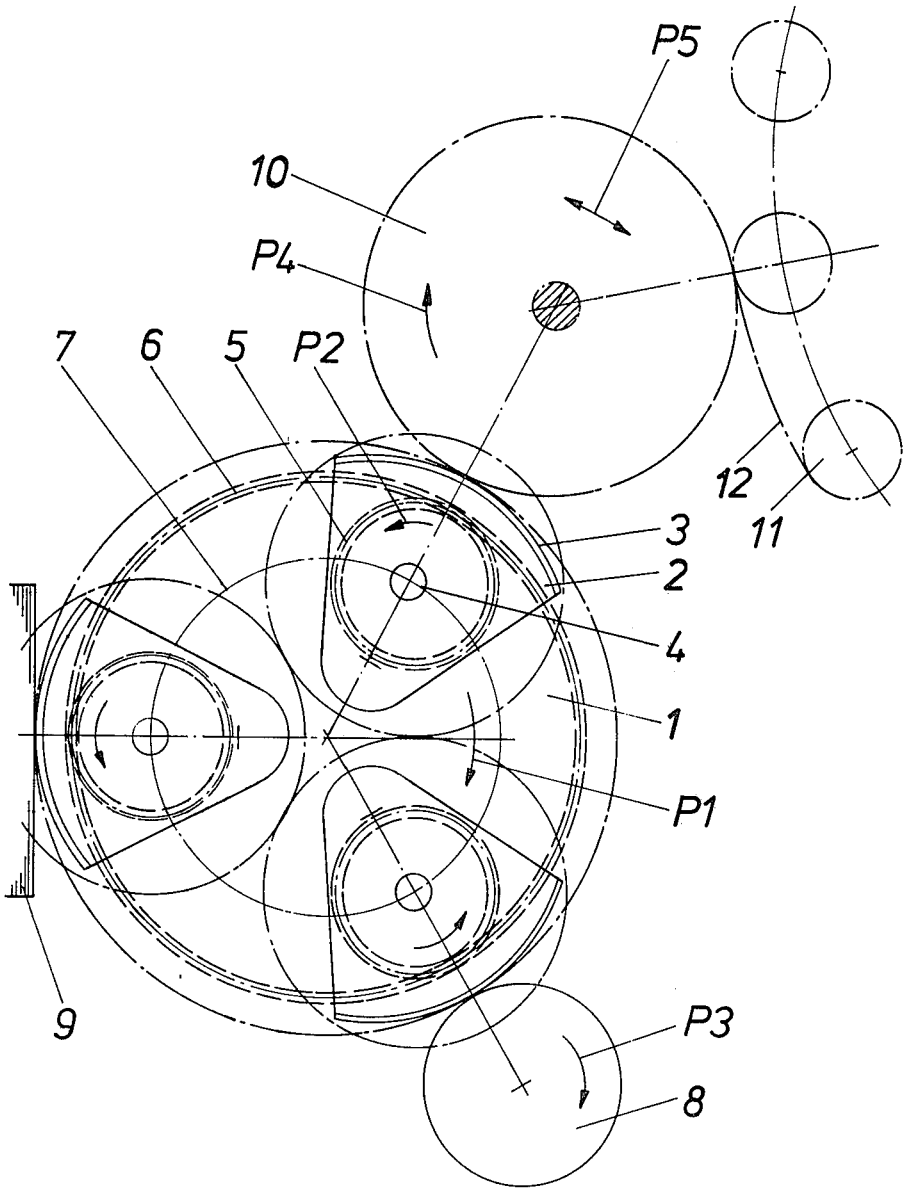
FIG. 1 is a diagrammatic plan view of a labeling station.
Figure 2:
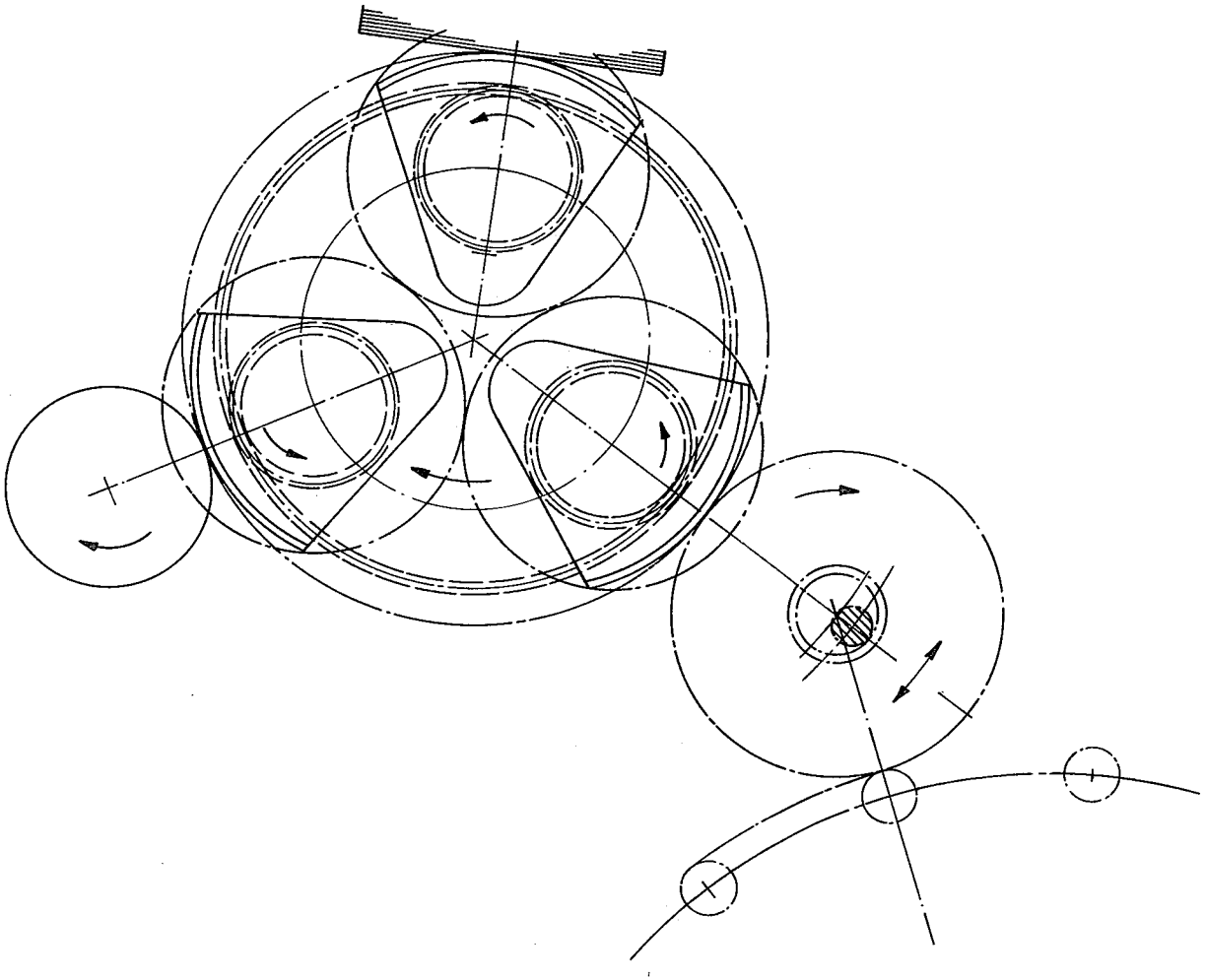
FIG. 2 is a diagrammatic plan view of the labeling station of FIG. 1 with a gripper cylinder of smaller diameter.

Referring now to FIGS. 1 and 2, three pickup elements 2 are eccentrically arranged on a carrier 1 rotating at constant angular velocity in the direction of the arrow P1. Each pickup element 2 rotates in the direction of the arrow P2 about a drive shaft 4 located between its convexly curved pickup face 3 and the corresponding center of curvature. Mounted on the drive shaft 4 is a planet gear 5 which meshes with a stationary sun gear 6. With the carrier 1 rotating, the pickup elements 2 are moved along a circular path 7 with simultaneous self-rotation past various stations, namely, a glue roll 8 rotating in the direction of the arrow P3, a stationary label stack 9, and a gripper cylinder 10 rotating in the direction of the arrow P4. To enable the pickup face 3 of the pickup elements 2 to roll along the differently curved surfaces of the stations 8, 9 and 10, a cam-controlled linkage, which is not shown, is associated with each pickup element 2.

The pickup faces 3 coated with glue, at the glue roll 8 upon rolling along the flat front of the label stack 9 pick up the uppermost label by adhesive action and bring it within the reach of the gripper cylinder 10. The latter pulls the label away from the pickup face by means of gripping elements and transfers it to objects, e.g., bottles 11, which are moved past the gripper cylinder 10 along a path 12 which is convexly curved relative to the gripper cylinder 10.

The gripper cylinder 10 is drivewise coupled to the carrier 1 through a gear train so that there is a fixed rotative-speed relation between the carrier 1 and the gripper cylinder 10. The entire unit consisting of carrier 1 with pickup elements 2, glue roll 8, label stack 9 and gripper cylinder 10 may be moved in the direction of the arrow P5 toward the curved path 12. Since the labeling station is turned as a unit, the geometric and drive relationships between the pickup elements and the individual stations such as glue roll, label stack and gripper cylinder are maintained so that the pickup elements 2 continue to roll along the individual stations.

Details not depicted herein are incorporated by reference from U.S. Pat. No. 4,118,269.

Figure 3:
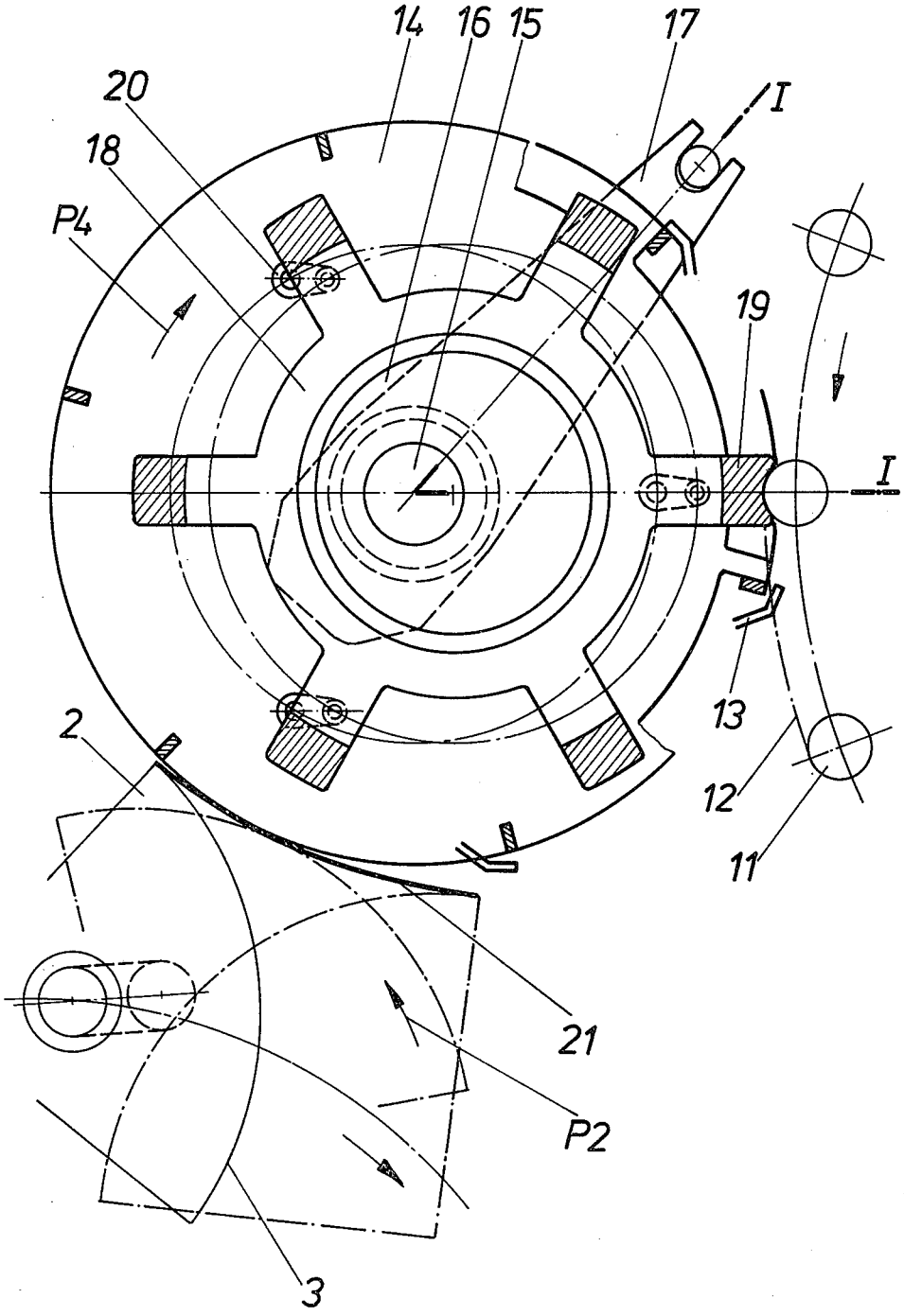
FIG. 3 is a plan view on an enlarged scale of the gripper cylinder of FIG. 2.
Figure 4:
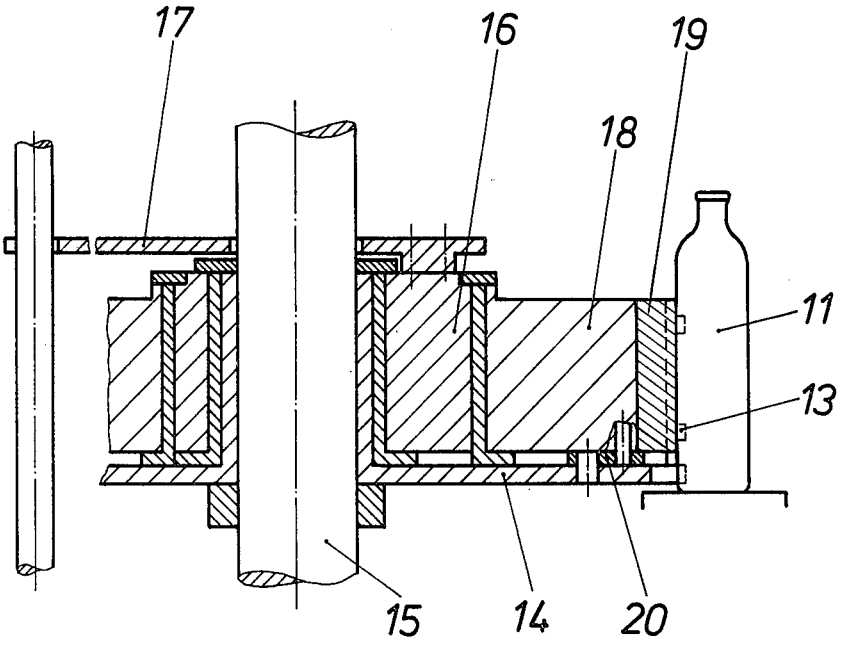
FIG. 4 shows the gripper cylinder of FIG. 3 in an axial cross section taken along the line I—I.
Figure 5:
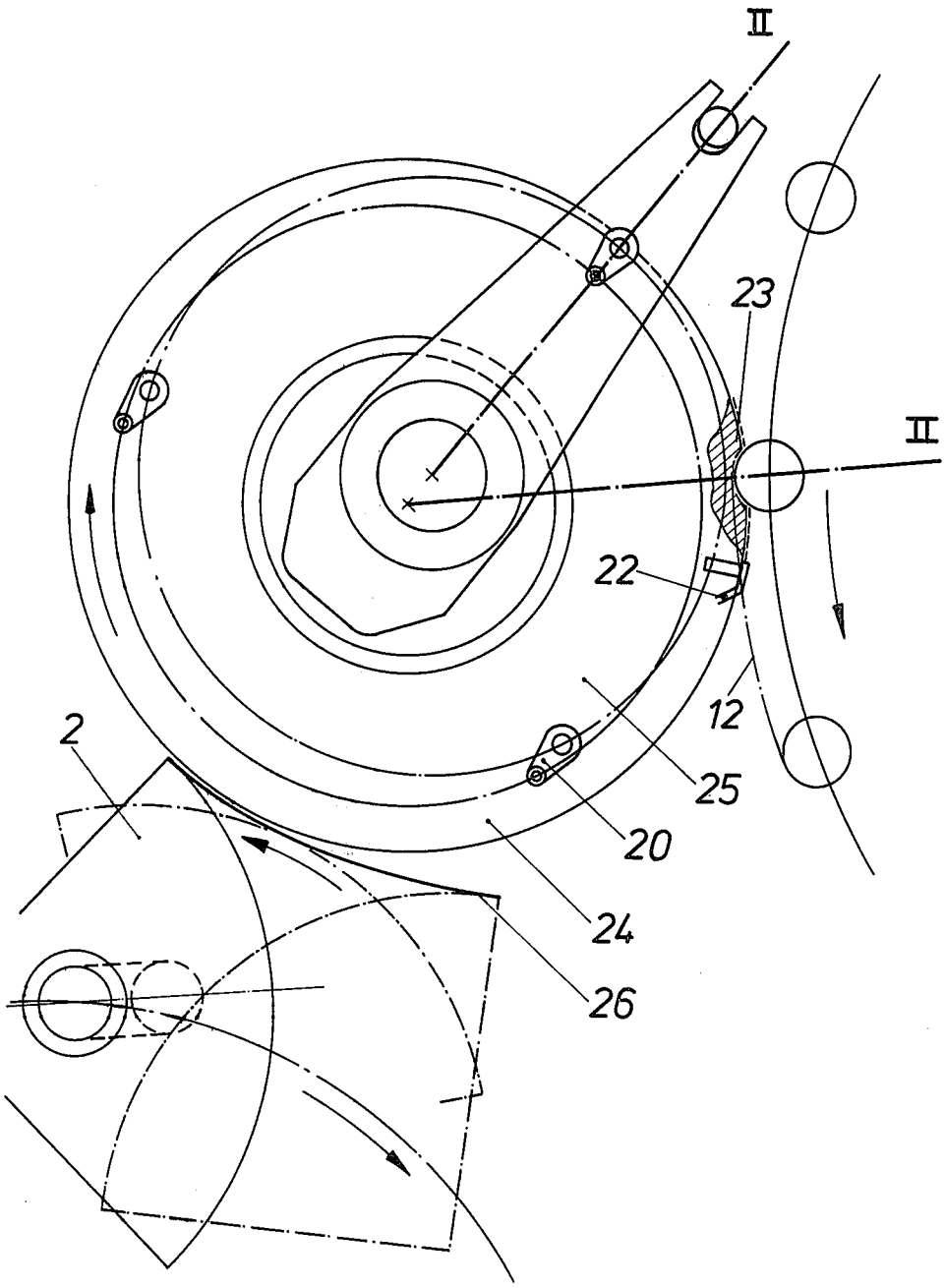
FIG. 5 is a plan view on an enlarged scale of the gripper cylinder of FIG. 2 is an embodiment that is a modification of the one of FIG. 3.
Figure 6:
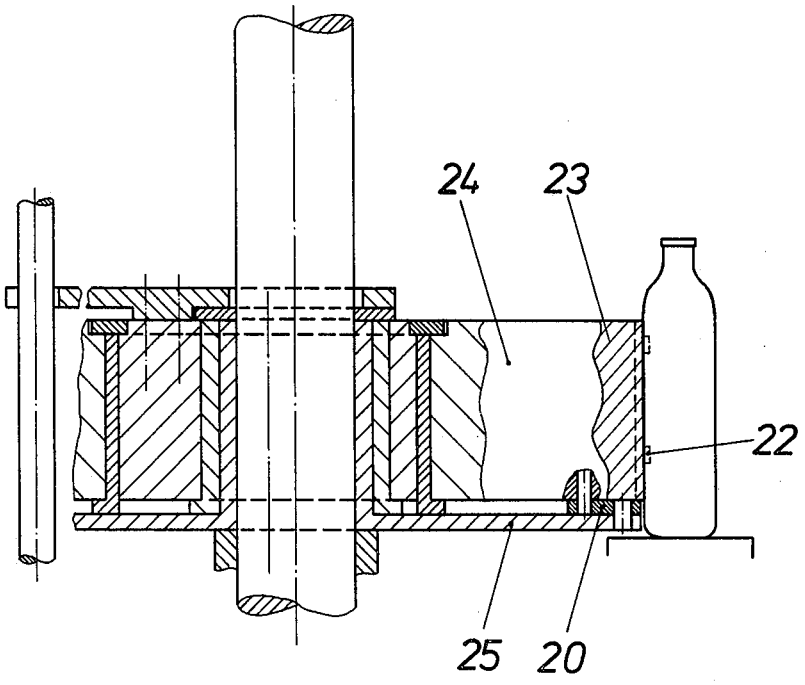
FIG. 6 shows the gripper cylinder of FIG. 5 in an axial section taken along the line II—II.
Figure 7:
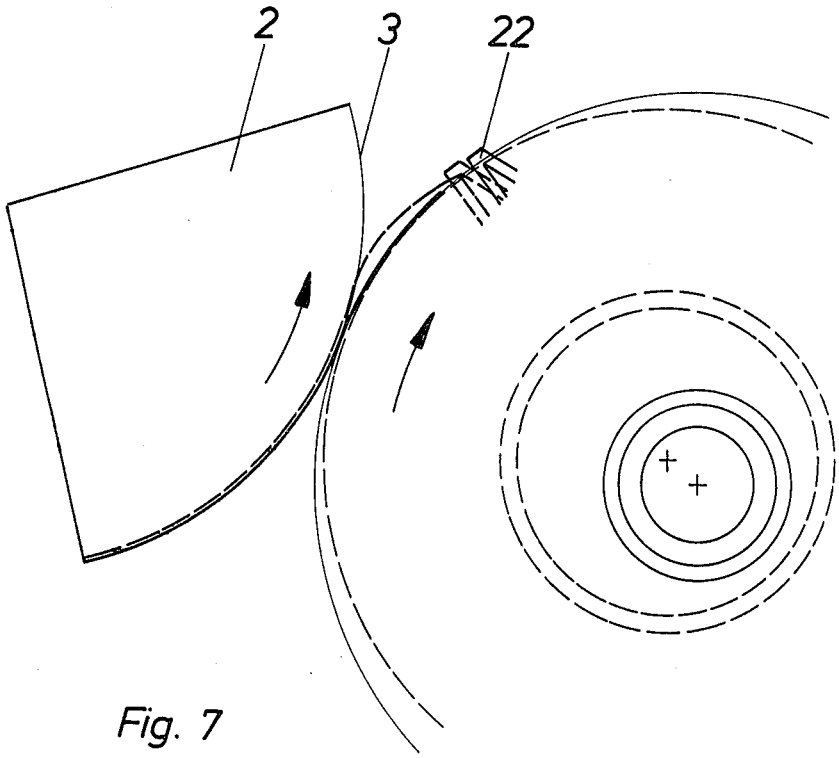
FIGS. 7 and 8 show various phases in the takeup of the labels by the gripper cylinder from the pickup elements.
Figure 8:
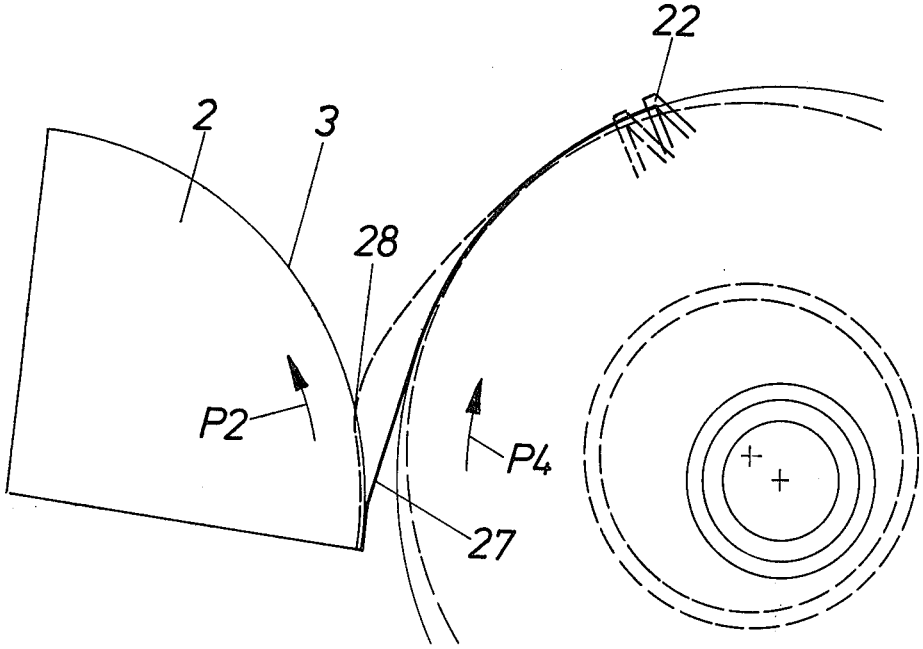

In the embodiment of FIGS. 3 and 4 the gripping elements 13 are arranged on a carrier 14 concentrically with the gripper-cylinder axis 15 so that they revolve along a circular path. The carrier 14 is coupled drivewise to the carrier 1 through the aforesaid gear train which is not shown. Mounted on the drive shaft 15 is, moreover, an eccentric 16 whose position is adjustable through an arm 17. A carrier 18 which carries pressing elements 19 is pivoted on the eccentric 16. The carrier 18 is coupled to the direct-driven carrier 14 in the manner of a kind of double crank through a plurality of links 20 distributed over the circumference so that the two carriers 14 and 18 rotate with the same angular velocity. Since the circumference of the carrier 18 provided with the pressing elements 19 is smaller than the circumference of the carrier 14 provided with the gripping elements 13, the path speed of the pressing elements 19 is less than the path speed of the gripping elements 13 with the equal angular velocity of these two parts.

As is apparent from FIG. 3, the path of rotation of the gripping elements 13 is tangent to the roll path 21 described by the pickup element 2. This means that the gripping elements 13 are able to pick up and pull the labels away from the pickup face 3 of the pickup elements 2. Through proper choice of the diameter of the carrier 14 carrying the gripping elements 13, provision may further be made for synchronism to exist between the pickup elements 2 and the gripping elements 13. However, as will be shown further on in connection with another exemplified embodiment, this second condition is not essential to satisfactory takeoff of the labels. What is important is that the path of the gripping elements 13 be tangent to the path 21 of the pickup elements 2.

The diameter of the carrier 18 carrying the pressing elements 19 is selected so that, with due regard to the angular velocity, their path speed corresponds to the path speed of the areas to be labeled on path 12. By means of the eccentric 16, the carrier 18 carrying the pressing elements 19 may be brought into a position in which the pressing elements 19 are tangent to or slightly intersect the path 12 of the areas to be labeled, as shown in FIG. 3.

When the labeling station is to be used to label objects of another format, for example, smaller-diameter bottles 11, the entire labeling station must be swung around in the direction of the arrow P5. Moreover, the carrier 18 must be replaced with a corresponding carrier with pressing elements but of smaller diameter if the path 12 has a smaller radius of curvature, and of larger diameter if the path 12 has a larger radius of curvature. In addition to turning the entire labeling station in the direction of the arrow P5 and replacing the carrier carrying the pressing elements, the eccentric 16 must be shifted so that the pressing elements 19 are tangent to or slightly intersect the path of the areas to be labeled.

The embodiment of FIGS. 5 to 8 differs from the embodiment of FIGS. 3 and 4 in that the gripping elements 22 and the pressing elements 23 are disposed on a common carrier 24 which is coupled through links 20 in the manner of a kind of a double crank with a driver plate 25 which drivewise is coupled to the carrier 1, as described in connection with the embodiment of FIG. 1. Apart from this, the mounting of the carrier 24 on the eccentric corresponds to that of the embodiment of FIGS. 3 and 4. In this embodiment, the carrier 24 with the gripping and pressing elements 22 and 23 is brought into a position, by turning the labeling station as a whole in the direction of the arrow P5, in which the pressing elements are tangent to or slightly intersect the path 12 of the areas to be labeled. By shifting the eccentric, the carrier 24 with the gripping and pressing elements 22 and 23 may be brought into a position in which their path of rotation is tangent to the roll path 26 of the pickup elements 2.

Since the path speed of the gripping and pickup elements 22 and 23 is designed only for the path speed of the areas to be labeled, the path speed may in this case differ from the path speed of the pickup elements 2. When a carrier is replaced with a smaller-diameter carrier for adaptation to the path speed of the areas to be labeled, this different path speed will not have an adverse effect on the takeoff of labels from the pickup face 3 of the pickup elements 2, as may be seen from FIGS. 7 and 8. While with a large diameter (solid line) the label 27 to be pulled away is pulled tangentially from the pickup face 3, with a smaller diameter (dashed line) it will merely shift the pullaway point 28 somewhat. In no case is the label 27 subjected to forces in the tangential direction of the pickup face 3.

Figure 9:
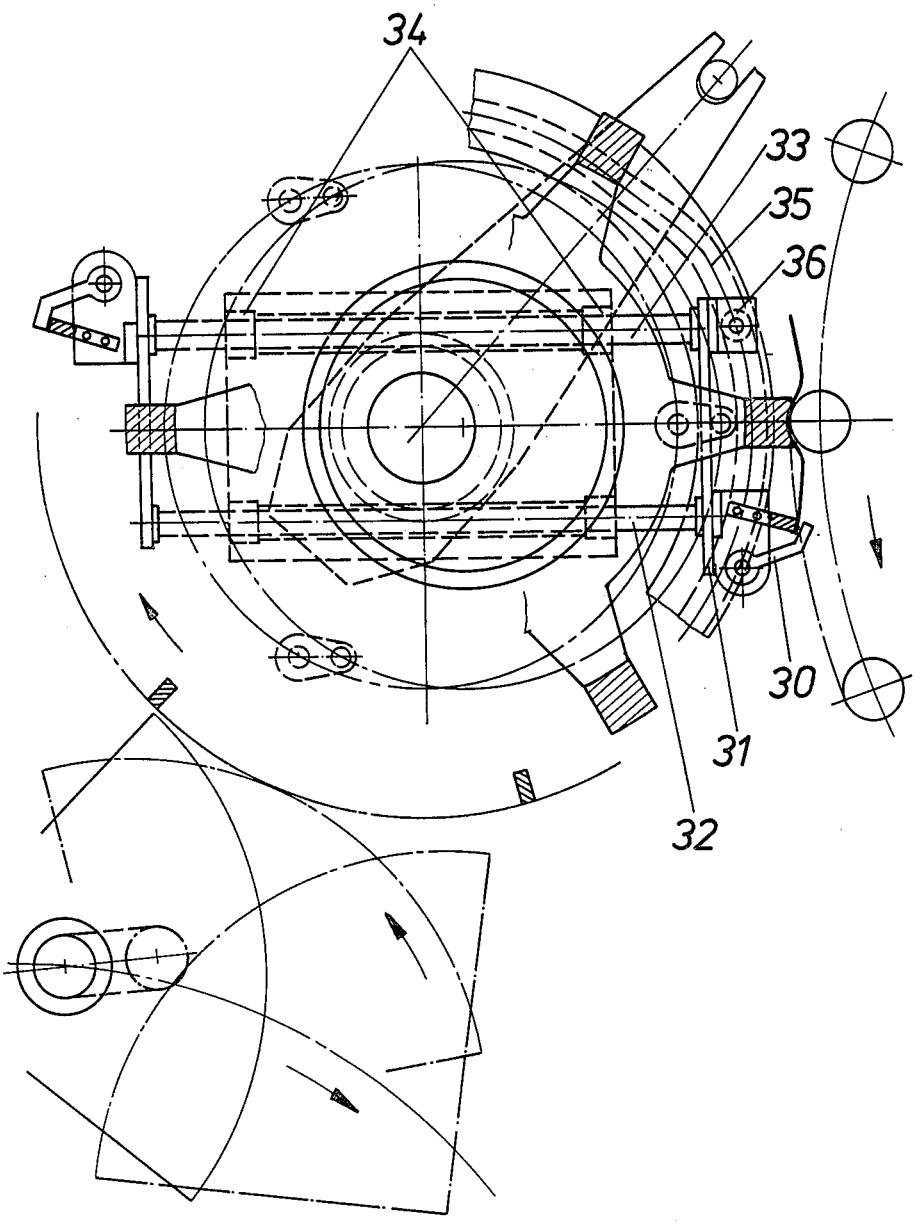
FIG. 9 is a plan view on an enlarged scale of the gripper cylinder of FIG. 2 with radially exchangeable gripping elements.
Figure 10:
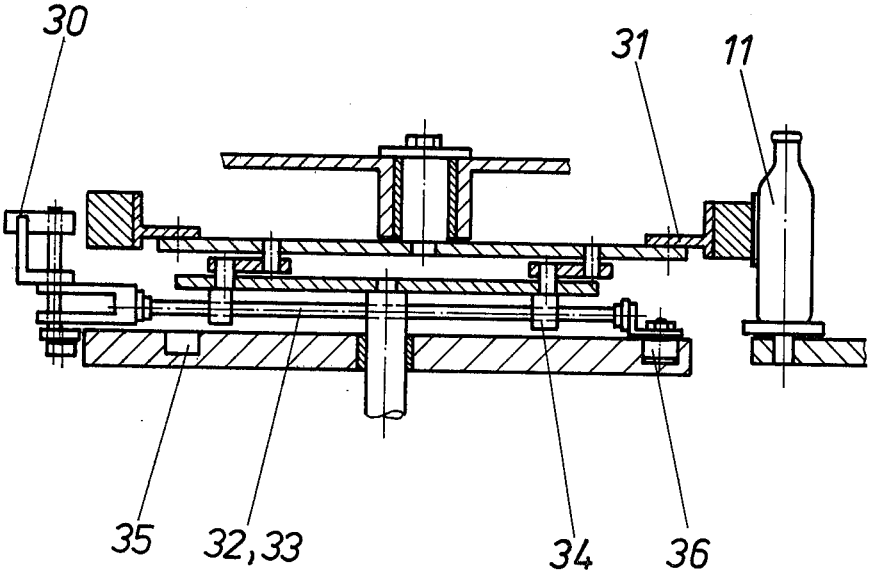
FIG. 10 shows the gripper cylinder of FIG. 9 in axial section.

Under certain conditions the rotatability of the entire unit in the direction of the path 12 of the objects to be labeled may be limited in such a way that the path of rotation of the gripping elements is too remote from the path of the areas to be labeled to assure reliable transfer or takeover by the pressing elements in the case of relatively short lables. This will be the case, for example, when two labels are to be affixed simultaneously, one above the other, on a bottle which has a neck of very small diameter in relation to its body. In this case the gripper cylinder assigned to the neck cannot be brought close enough to the path of the neck areas to be labeled. In order to nevertheless bring the labels into a position close to the area to be labeled that is favorable for the pressing elements, the gripping elements may, by way of modification of the embodiment of FIGS. 3 and 4, be radially controlled through a cam-control arrangement in the vicinity of the objects to be labeled. The embodiment shown in FIGS. 9 and 10 differs from the embodiment shown in FIGS. 3 and 4 in that the gripping elements 30 are not disposed on the circumference of a carrier concentrically with the carrier axis but rather on a holder 31 which by means of guide rods 32 and 33 is mounted in a guide 34 so as to be radially movable. Radial deflection occurs as a function of the profile of a grooved cam 35 in which the holder 31 is guided by means of a guide roller 36. This refinement of the invention makes it possible on the one hand to obtain a large tangential range in the vicinity of the pickup elements and, on the other hand, to bring the labels into optimum position for the pressing elements in the region where the labels are transferred to the objects to be labeled. To this end the gripping elements may even be made to go beyond the circle which it describes in the tangential range of the pickup elements.

It will be appreciated that the instant specification and examples are set forth by way of illustration and not limitation, and that various modifications and changes may be made without departing from the spirit and scope of the present invention.

What is claimed is:

1. In a labeling station for applying labels onto objects, having at least one pickup element mounted eccentrically on a rotatable carrier for movement about an axis, a gripper cylinder comprising a shaft and a rotating carrier having eccentrically disposed gripping and pressing elements on portions thereof, which elements are tangent to the circulation path of the pickup elements approximately in synchronism, the labels being transferred by the gripping and pressing elements to objects moved along a transport path, the portion of the gripper cylinder which carries the pressing elements being eccentrically mounted on the gripper-cylinder shaft in such a way that the areas to be labeled of the objects are tangent to or slightly intersected by the path of rotation of the pressing elements, and the portion carrying the pressing elements and the portion carrying the gripping elements rotate with the same angular velocity, the improvement comprising means for adjusting the rotative speed of the pressing elements from the path speed of the areas to be labeled of a first group of objects being conveyed along an arcuate path whose areas to be labeled are at a first distance from the cylindrical axis of the gripper cylinder to the path speed of the areas to be labeled of another group of objects thereafter being conveyed along an arcuate path, at a different distance from the cylindrical axis of the gripper-cylinder including means for releasably replacing the portion carrying the pressing elements with another portion of a different diameter.

2. Labeling station as defined in claim 1, wherein the portion carrying the pressing elements and the portion carrying the gripping elements are eccentrically mountable on the gripper-cylinder shaft as exchangeable units.

3. Labeling station as defined in claim 1 or claim 2, further comprising for each gripping element, a cam in which a follower associated with the gripping element is guided for the radial control thereof.

* * * * *